US005979720A

United States Patent [19]

Nomura et al.

[11] Patent Number: 5,979,720

[45] Date of Patent: Nov. 9, 1999

[54] NOZZLE FOR THE CONTINUOUS CASTING OF STEEL

[75] Inventors: Osamu Nomura; Ryosuke Nakamura; Wei Lin, all of Okayama, Japan

[73] Assignee: Shinagawa Refractories Co., Ltd., Tokyo, Japan

[21] Appl. No.: 09/101,555

[22] PCT Filed: Nov. 14, 1997

[86] PCT No.: PCT/JP97/04162

§ 371 Date: Jul. 13, 1998

§ 102(e) Date: Jul. 13, 1998

[87] PCT Pub. No.: WO98/22243

PCT Pub. Date: May 28, 1998

[30] Foreign Application Priority Data

Nov. 18, 1996 [JP] Japan ..... 8-306656

[51] Int. Cl.[6] ..... B22D 11/10

[52] U.S. Cl. ..... 222/606; 266/280

[58] Field of Search ..... 266/280, 236; 222/606, 607, 591; 164/437

[56] References Cited

U.S. PATENT DOCUMENTS

| | | | |
|---|---|---|---|
| 4,210,264 | 7/1980 | Kondo | 222/591 |
| 4,510,191 | 4/1985 | Kagami et al. | 222/606 |
| 4,682,718 | 7/1987 | Wanatabe et al. | 222/606 |

FOREIGN PATENT DOCUMENTS

| | | |
|---|---|---|
| 0 818 259 | 1/1998 | European Pat. Off. . |
| 63-108950 | 5/1988 | Japan . |
| 2-172859 | 7/1990 | Japan . |
| 4-37454 | 2/1992 | Japan . |
| 7-51819 | 2/1995 | Japan . |
| 8-39211 | 2/1996 | Japan . |
| 2 056 430 | 3/1981 | United Kingdom . |

OTHER PUBLICATIONS

U.S. Patent Application, Serial No. 08/889,811, filed Jul. 8, 1997, by Takashi Yamamura et al., entitled "Nozzle For Use In Continuous Casting of Steel", located in Group Art Unit 1742.

Japanese Patent Abstract JP408002975A of Japanese Application No. JP 06137542, Jan. 1996.

Database WPI, Section Ch, Week 7626, Derwent Publications Ltd., London, GB, Class M22, AN 76–49024X, XP002083540 & JP 51 054836 A 9Nippon Steel Corp), May 14, 1976 * abstract *.

Patent Abstracts of Japan, vol. 016, No. 034 (M–1204), Jan. 28, 1992 & JP 03 243258 A (Nisshin Steel Co. Ltd), Oct. 30, 1991 * abstract *.

Patent Abstracts of Japan, vol. 017, No. 548 (M–1490), Oct. 4, 1993 & JP 05 154628 A (Kurosaki Refract Co Ltd; Others: 01), Jun. 22, 1993 * abstract*.

Patent Abstracts of Japan, vol. 096, No. 007, Jul. 3, 1996 & JP 08 057601 A (Kurosaki Refract Co Ltd; Nippon Steel Corp), Mar. 5, 1996 * abstract *.

Database WPI, Section Ch, Week 8208, Derwent Publications Ltd., London, GB; Class A81, A82–14704E, XP002083541 & JP 57 07868 A (Harima Taika Renga KK), Jan. 16, 1982 * abstract *.

*Primary Examiner*—Scott Kastler
*Attorney, Agent, or Firm*—Wenderoth, Lind & Ponack, LLP

[57] ABSTRACT

A nozzle for use in continuous casting of steel simultaneously provides resistance to adhesion of $Al_2O_3$ inclusions, damage resistance, and spalling resistance. The refractory material of at least the interior surface of the nozzle and/or the portions to come into contact with molten steel is composed of amorphous silica and alumina and has a chemical composition of 5 to 40 percent by weight of $SiO_2$, 60 to 95 percent by weight of $Al_2O_3$, and 3 percent by weight or less of unavoidable impurities.

1 Claim, 2 Drawing Sheets

NOZZLE FOR THE CONTINUOUS CASTING OF STEEL

INDUSTRIAL FIELD OF THE INVENTION

The present invention relates to nozzles used in continuous casting of steel, such as submerged nozzles, long nozzles, etc.

PRIOR ART $Al_2O_3$—$SiO_2$—C nozzles have been the most widely used in the continuous casting of aluminum killed steel because of their superior resistance to corrosion and spalling. However, blockage inside the nozzle pipe remains a problem due to the adhesion of $Al_2O_3$ inclusions caused by deoxidization of aluminum in the steel.

The mechanism behind the blockage is as follows:

Firstly, in a refractory at high temperature, Reaction (1) occurs between the $SiO_2$ and C used as raw materials. The gaseous SiO and gaseous CO generated diffuse at the interface between the nozzle and the molten steel and react with the Al in the steel according to Reactions (2) and (3), to form a layer of $Al_2O_3$ network on the inner wall of the nozzle, which initiates the adhesion of $Al_2O_3$ inclusions.

$$SiO_2(s)+C(s)=SiO(g)+CO(g) \quad (1)$$

$$3SiO(g)+2\underline{Al}=Al_2O_3(s)+3\underline{Si} \quad (2)$$

$$3CO(g)+2\underline{Al}=Al_2O_3(s)+3\underline{C} \quad (3)$$

Here (s) stands for solid phase, (g) stands for gaseous phase, and $\underline{Al}$, $\underline{Si}$, and $\underline{C}$ represent Al, Si, and C dissolved in the molten steel, respectively.

As the adhesion of $Al_2O_3$ inclusions progresses, nozzle blockage will occur. This not only shortens the working life of the nozzle, but also impedes continuous casting operation. Therefore, it is important to prevent the nozzle blockage.

To try to solve the above problems, Japanese Patent Laid-Open No. 51-54836 discloses a method of coating the interior surface of a submerged nozzle with a refractory containing no carbon with the aim of preventing Reaction (1), in other words, the inner surface of the nozzle runner is covered with a refractory containing one or more of $Al_2O_3$, $MnO_2$, MgO, CaO, or $SiO_2$. However, the range of 90 to 99 percent by weight of $SiO_2$ considered desirable in said publication creates a layer of $Al_2O_3$ network on the inner wall of the nozzle by Reaction (4) below:

$$3SiO_2(s)+4\underline{Al}=2Al_2O_3(s)+3\underline{Si} \quad (4)$$

The $Al_2O_3$ thus formed and the $Al_2O_3$ inclusions in the steel adhere to the surface of the $SiO_2$ then dissolve into the $SiO_2$ and form a layer with a melting point less than 1600° C. In continuous casting, this layer with a low melting point is swept away by the molten steel causing damage to the nozzle.

As a countermeasure to this, Japanese Patent Laid-Open No. 3-243258 discloses a carbonless high alumina refractory having at least 90 percent by weight or more of $Al_2O_3$ (or MgO) and containing not more than 5 percent by weight of $SiO_2$. Further, Japanese Patent Laid-Open No. 5-154628 discloses a nozzle for use in continuous casting whose interior body is composed mainly of alumina clinker with an alumina content of at least 99 percent by weight, having a refractory component with an alumina content of at least 70 percent by weight, a carbon content of less than 1 percent by weight, and a silica content of less than 1 percent by weight, and having a grain constitution in which 20 to 70 percent by weight of the grains are 0.21 mm or less.

These interior bodies can be made by simultaneously pressure molding the raw material mix of the interior body and the raw material mix of the main body of the nozzle, or by packing the raw material mix of the interior body onto the preformed main body of the nozzle to finish it. However, in either method, the coefficient of expansion of the carbonless material composing the interior body filling the interior is markedly greater than the coefficient of expansion of the carbonaceous material in the main body of the nozzle and cracks may form in the nozzle matrix during preheating and during use.

Problems the Invention Aims to Solve

To overcome this, Japanese Patent Laid-Open No. 8-57601 discloses a nozzle for use in continuous casting characterized in that in the latter manufacturing process, where the main body of a nozzle for use in continuous casting is formed from a refractory material containing a source of carbon and the portions through which molten steel will flow or with which molten steel will come into contact are coated with a refractory material containing no carbon source, said portions coated with a refractory material containing no carbon source are the interior wall, the bottom of the hole, the discharge portions, and the external portions to be immersed in molten steel, and said coated portions are formed into a cylindrical shape from refractory material containing no carbon, and further said cylindrical shaped body is constructed with joints which are 0.5 to 2.0 mm wide in said straight wall portions and 1 to 5 mm wide in said bottom and discharge portions. However, in this case, molten steel can penetrate the joints and cause the interior lining to peel away during casting.

Thus, the object of the present invention is to provide a nozzle for use in continuous casting of steel which simultaneously provides resistance to adhesion of $Al_2O_3$ inclusions, damage resistance, and spalling resistance.

Means of Solving the Problems

The nozzle for use in continuous casting of steel according to the present invention is characterized in that the refractory of at least the interior surface of the nozzle and/or the portions to come into contact with molten steel is composed of amorphous silica and alumina and has a chemical composition of 5 to 40 percent by weight of $SiO_2$, 60 to 95 percent by weight of $Al_2O_3$, and 3 percent by weight or less of unavoidable impurities.

Further, the nozzle for use in continuous casting of steel according to the present invention is characterized in that the refractory of at least the interior surface of the nozzle and/or the portions to come into contact with molten steel is made using raw refractory materials having a grain size of 1000 $\mu$m or less and in which the ratio of grains of 0.5 to 1000 $\mu$m is at least 80 percent by weight.

In addition, the nozzle for use in continuous casting of steel according to the present invention is characterized in that the thickness of the refractory of at least the interior surface of the nozzle and/or the portions to come into contact with molten steel is 2 to 10 mm.

OPERATIONS

Figure 1:
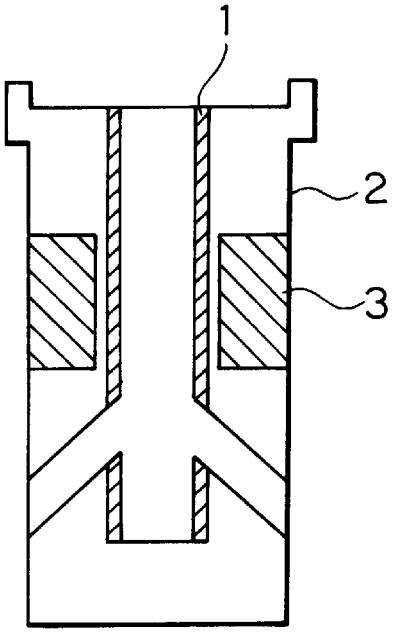
FIG. 1 shows an embodiment of the distribution of materials in the nozzle of the present invention.

The present invention will now be explained in detail.

The nozzle for use in continuous casting of steel according to the present invention (hereinafter simply "the nozzle") is characterized in that the refractory of at least the interior surface of the nozzle and/or the portions to come into contact with molten steel is an $Al_2O_3$—$SiO_2$ refractory material composed of amorphous silica and alumina and has a chemical composition of 5 to 40 percent by weight of $SiO_2$, 60 to 95 percent by weight of $Al_2O_3$, and 3 percent by weight or less of unavoidable impurities.

As is well known, alumina has a large coeffiecient of thermal expansion and tends to split easily when heated or cooled rapidly. Consequently, when high purity alumina is used as a refractory material for steel making, there is a risk that the molten steel will leak because of cracks in the refractory material. This is not merely an impediment to smooth operations, it is unsafe.

On the other hand, the coefficient of thermal expansion of amorphous silica is extremely small. Whereas, for instance, the coefficient of thermal expansion of alumina is 0.82 percent at 1000° C., that of amorphous silica is only 0.05 percent. Consequently, if amorphous silica is added to alumina, the amorphous silica will absorb the expansion of the alumina during heating and cooling, and as a result the spalling resistance of refractories containing alumina can be improved.

However, as explained below, if there is only a little amorphous silica, and the content thereof in the form of $SiO_2$ is less than 5 percent by weight, the ratio will be too small and the resistance of the refractory to spalling will not be enough to meet the conditions of actual use.

On the other hand, if there is a lot of amorphous silica and the content of $SiO_2$ exceeds 40 percent by weight, there is no problem with spalling resistance, but a low melting point phase, in which the melting point is less than 1600° C., arises and the ratio of said low melting point phase is too great, which leads to damage resulting from refractory being washed away by the flow of molten steel, etc.

Consequently, it is desirable that the composition of the refractory of at least the interior surface of the nozzle and/or the portions to come into contact with molten steel is within the range of 5 to 40 percent by weight of $SiO_2$and 60 to 95 percent by weight of $Al_2O_3$. Further, if the $SiO_3$ is in the range of 28 to 40 percent by weight, the low melting point phase does arise, but the ratio thereof is small and there is hardly any damage to the refractory as explained in the examples below.

Also, during preparation of the refractory, some unavoidable impurities may be present in the binders, etc. used to form the raw material mix (C, CaO, etc.), or in the starting materials ($TiO_2$, MgO, or $Na_2O$, $K_2O$, etc. contained in β-alumina), but these unavoidable impurities can be tolerated if they total 3 percent by weight or less.

As explained above, the refractory material composed of amorphous silica and alumina used in at least the portions of the nozzle according to the present invention to come into contact with molten steel is essentially an $Al_2O_3$—$SiO_2$ refractory composed of $Al_2O_3$ and $SiO_2$, and carbon is essentially absent, so that Reactions (1) to (3) above can be reduced.

Also, $Al_2O_3$ does form on the working surfaces of the nozzle in accordance with Reaction (4) above, but this $Al_2O_3$ does not form a network and does not lead to adhesion of $Al_2O_3$ inclusions from the molten steel. Consequently, nozzle blockage due to adhesion of $Al_2O_3$ inclusions does not occur.

Thus, the $Al_2O_3$—$SiO_2$ refractory used in the nozzle according to the present invention can be applied to the interior surface and/or the portions to come into contact with molten steel of any nozzle used in continuous casting, such as long nozzles or submerged nozzles, or it can be used for the entire body of any nozzle used in continuous casting, such as long nozzles or submerged nozzles.

When the entire body is to be composed solely of the $Al_2O_3$—$SiO_2$ refractory, the prescribed raw refractory materials can be mixed with a conventional/commonly known binder, such as cement, and the mix formed into the required nozzle shape by cold isostatic pressing, etc., then dried and fired. The mix can also be cast or injection molded, dried, and fired where necessary.

Some contamination may occur depending on the type of binder, such as carbon in a binder such as phenolic resin or CaO in cement, for instance, but since their quantity is small, these can be regarded as unavoidable impurities. These unavoidable impurities will not pose any particular problem if they remain 3 percent by weight or less of the total unavoidable impurities contained in the starting materials.

When the $Al_2O_3$—$SiO_2$ refractory material is applied to the interior surface of the nozzle and/or the portions to come into contact with molten steel, the interior surface of the nozzle and/or the portions to come into contact with molten steel may be manufactured either by simultaneously pressure molding the raw material mix of the $Al_2O_3$—$SiO_2$ refractory material composing these portions and the raw material mix of the refractory material composing the main body of the nozzle into the required nozzle shape (simultaneous molding), or by packing the raw material mix making up the raw $Al_2O_3$—$SiO_2$ refractory composing the interior and/or the portions to come into contact with molten steel onto the performed main body of the nozzle to finish it (finishing). Further, conventional refractory materials, such as alumina-carbon, zirconia-carbon, etc., can be used for the main body (matrix) of the nozzle.

Figure 2:
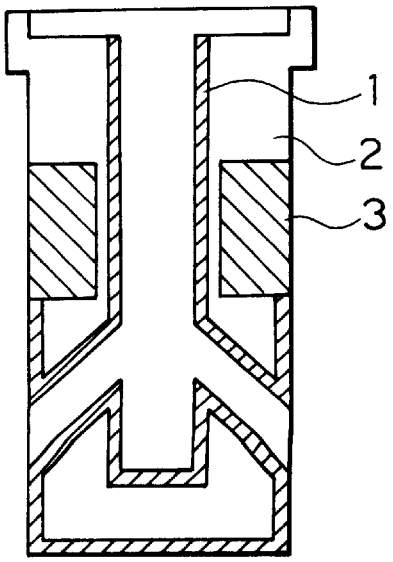
FIG. 2 shows another embodiment of the distribution of materials in the nozzle of the present invention.
Figure 3:
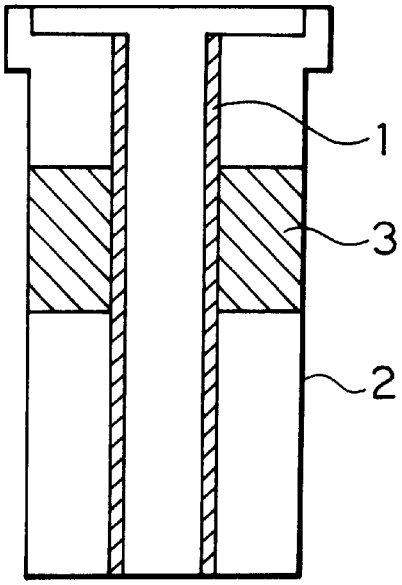
FIG. 3 shows another embodiment of the distribution of materials in the nozzle of the present invention.

Several examples of the distribution of materials in the nozzle according to the present invention are given in FIGS. 1 to 4. Here, FIGS. 1 to 3 show submerged nozzles with $ZrO_2$—C refractory material arranged around the powder line (3). The powder line is the portion which comes into contact with the highly corrosive mold powder when the submerged nozzle is used, and the $Al_2O_3$—C refractory material composing the main body (2) of the nozzle has been replaced in this region by the $ZrO_2$—C refractory material, which has superior corrosion resistance, to reinforce the powder line. Further, $Al_2O_3$—C refractory materials and $ZrO_2$—C refractory materials of ordinary composition can be used, for instance, $Al_2O_3$—C refractory material composed of 30 to 90 percent by weight of $Al_2O_3$, 0 to 35 percent by weight of $SiO_2$, and 10 to 35 percent by weight of C, or $ZrO_2$—C refractory material composed of 66 to 88 percent by weight of $ZrO_2$, 2 to 4 percent by weight of CaO, and 10 to 30 percent by weight of C, for example, when CaO stabilized $ZrO_2$ is used. Further, CaO stabilized $ZrO_2$ is the most widely used form of $ZrO_2$, but MgO stabilized $ZrO_2$, $Y_2O_3$ stabilized $ZrO_2$, baddeleyite, etc., may also be used.

Also, when manufacturing by simultaneous molding, the raw material mix of the alumina-carbon or other refractory material composing the main body of the nozzle which has been mixed with phenolic resin or polysaccharide as a binder, and the raw material mix of the $Al_2O_3$—$SiO_2$ refractory material composing the interior surface of the nozzle and/or the portions to come into with molten steel can be packed into their required positions in the mold, then formed by cold isostatic pressing, etc., dried, and used unfired or fired.

When manufacturing by finishing, a blended raw material mix containing binders such as cement, silicate, phosphate, etc., can be cast molded or injection molded around the main body of a nozzle which has been performed by a conventional method, then dried and, where necessary, fired, or separately made pressure molded, cast molded or injection molded interior portions (interior surface and/or portions to come into contact with molten steel) can be loaded into the main body (matrix) of a nozzle which has been performed by a conventional method.

Further, when making the $Al_2O_3$—$SiO_2$ refractory used in the present invention, it is preferable that the grain size of the raw starting materials be 1000 $\mu$m or less, and that at least 80 percent by weight of the grains be 0.5 to 1000 $\mu$m or less. If the grain the size is greater than 1000 $\mu$m, the maximum grain diameter will be too large compared to the thickness of the nozzle, which will cause the refractory structure to become brittle, and will cause grains to fall out, etc., during use. Also, it is not desirable for the ratio of grains of 5 $\mu$m or less to exceed 20 percent by weight, because the spalling resistance of the refractory declines and fractures form.

Further, when $Al_2O_3$—$SiO_2$ refractory material is used only on the interior surface of the nozzle and/or the portions to come into contact with molten steel, the thickness thereof should be in the range of 2 to 10 mm. It is not desirable for the thickness of said refractory to be less than 2 mm because the refractory material could melt during use and be unable to perform its desired function, and it is not desirable for the thickness to be greater than 10 mm because cracks form as a result of differences in coefficient of expansion between it and the refractory material composing the main body (matrix) of the nozzle (reduced spalling resistance).

EXAMPLES

The tests of spalling resistance, damage resistance, and alumina adhesion resistance performed on each of the samples in the examples and comparative examples below will now be explained.

In the spalling tests, samples 40×40×230 mm in dimension were immersed in 1580° C. molten steel in an electric furnace for 5 minutes, then cooled in water and evaluated on the basis of crack formation. Ten samples were prepared and were evaluated by the total number of samples in which cracks had formed.

In the damage test, samples 40 mm in diameter and 230 mm in height were immersed in molten steel at 1580° C. and rotated for 30 minutes at a speed of 100 rpm, then evaluated by the decrease in diameter of each sample.

In the alumina adhesion tests, 1 percent by weight of aluminum was dissolved in molten steel at 1580° C., then samples 40 mm in diameter and 230 mm in height were immersed in said molten steel for 60 minutes and evaluated based on the thickness of alumina adhesion.

Example 1

Five percent by weight (outer percentage) of high-alumina cement (25 percent by weight of CaO; 75 percent by weight of $Al_2O_3$), 0.1 percent by weight (over percentage) of sodium acrylate, and a fixed amount of water were added to the mixture of starting materials shown in Table 1 below, blended, molded by vibration casting, then cured for 24 hours and dried for a further 24 hours at 105° C. to make samples.

The samples thus obtained were subjected to the spalling, damage, and alumina adhesion tests described above. The results obtained are given in Table 1.

TABLE 1

| | Inventive Product | | | | Comp. Product | | | |
|---|---|---|---|---|---|---|---|---|
| | 1 | 2 | 3 | 4 | 1 | 2 | 3 | 4 |
| Mix (wt %): | | | | | | | | |
| Alumina (0.5 to 300 $\mu$m) | 93 | 85 | 75 | 60 | 98 | 50 | 8 | |
| Alumina (<0.5 $\mu$m) | | | 5 | 5 | | | | |
| Amorphous Silica (500 to 1000 $\mu$m) | | | | 20 | | | | |
| Amorphous Silica (100 to 500 $\mu$m) | 4 | 15 | 16 | 15 | 2 | 50 | 92 | |
| Amorphous Silica (<0.5 $\mu$m) | 3 | | 4 | | | | | |
| Water mix (outer percentage): | | | | | | | | |
| Composition: | | | | | | | | |
| $Al_2O_3$ (wt %) | 93 | 85 | 80 | 65 | 98 | 50 | 8 | 41 |
| $SiO_2$ (wt %) | 7 | 15 | 20 | 35 | 2 | 50 | 92 | 28 |
| C (wt %) | | | | | | | | 31 |
| Physical properties: | | | | | | | | |
| Spalling test | 0 | 0 | 0 | 0 | 7 | 0 | 0 | 0 |
| Damage test | 0 | 0 | 0 | 0 | 0 | 2 | 4 | 0 |
| Alumina adhesion | 0 | 0 | 0 | 0 | 0 | 0 | 0 | 10 |

From the results shown in Table 1, the following can be ascertained:

1) Comparative Product 1, which had a composition of 98 percent by weight of $Al_2O_3$ and 2 percent by weight of $SiO_2$, had poor spalling resistance but there were no such problems with any of the other examples.

2) Damage resistance was poorest in Comparative Product 3, followed by Comparative Product 2 but there were no such problems with any of the other examples.

3) Alumina adhesion resistance was poor in Comparative Product 4 (conventional $Al_2O_3$—C refractory) but alumina adhesion was not observed in any of the other samples.

Consequently, the $Al_2O_3$—$SiO_2$ refractory used in the present invention can be seen to simultaneously provide spalling resistance, damage resistance and alumina adhesion resistance.

Example 2

The mixture of starting materials shown Table 2 below was used to make samples by the same method as in Example 1 and spalling, damage, and alumina adhesion tests were performed. The results obtained are given in Table 2.

TABLE 2

| | Inventive Product | | | | Comp. Product | |
|---|---|---|---|---|---|---|
| | 5 | 6 | 7 | 8 | 5 | 6 |
| Mix (wt %): | | | | | | |
| Alumina (>1000 μm) | | | | | 20 | |
| Alumina (0.5 to 300 μm) | 85 | 80 | 75 | 68 | 65 | 62 |
| Alumina (<0.5 μm) | | 5 | 10 | 17 | | 23 |
| Silica (>1000 μm) | | | | | 5 | |
| Amorphous Silica (500 to 1000 μm) | | | | | | |
| Amorphous Silica (100 to 500 μm) | 15 | 10 | 15 | 15 | 10 | 10 |
| Amorphous Silica (<0.5 μm) | | 5 | | | | 5 |
| Water mix (outer percentage): | | | | | | |
| Composition: | | | | | | |
| $Al_2O_3$ (wt %) | 85 | 85 | 85 | 85 | 85 | 85 |
| $SiO_2$ (wt %) | 15 | 15 | 15 | 15 | 15 | 15 |
| Physical Properties: | | | | | | |
| Spalling Test | 0 | 0 | 0 | 0 | * | 5 |
| Damage test | 0 | 0 | 0 | 0 | 0 | 0 |
| Alumina adhesion | 0 | 0 | 0 | 0 | 0 | 0 |

*grains fell out

From the results shown in Table 1, the following can be ascertained:

1) When the size of the largest grains in the starting materials exceeds 1000 μm, grains fall out of the surface of the samples.

2) When the ratio of starting materials of less than 0.5 μm is 20 percent by weight or less spalling resistance is barely affected, but when they exceed 20 percent by weight spalling resistance declines markedly.

3) Grain size has little effect on alumina adhesion resistance.

Example 3

Figure 4:
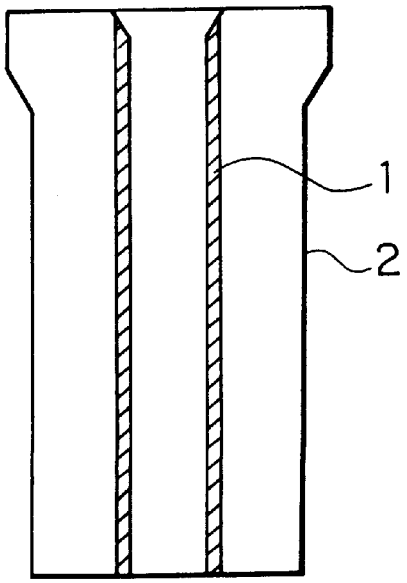
FIG. 4 shows another embodiment of the distribution of materials in the nozzle of the present invention.

Using a nozzle main body composed of the $Al_2O_3$—C refractory material of Comparative Product 4 shown in Table 1 above, nozzles (external diameter of nozzle 130 mm, internal diameter 70 mm, length 600 mm) with the nozzle interior material of Inventive Product 2 shown in Table 1 above were made with different thicknesses of interior material (1 mm, 2 mm, 5 mm, 10 mm, and 12 mm, but nozzle thickness constant). The samples were simultaneously molded by cold isotatic pressing, left for 24 hours, then dried for 24 hours at 105° C. The distribution of materials was as shown in FIG. 4.

The nozzle test samples thus obtained were immersed for 3 hours in steel containing 1 percent by weight of Al kept molten at 1580° C. in a high frequency furnace, then compared for spalling resistance by crack formation, and for corrosion resistance by the amount of melt damage to the inside of the pipe. Ten test samples were prepared and spalling resistance was evaluated by the total number of test samples in which cracks had formed. Corrosion resistance was evaluated by the average depth of melt damage to the inside of the pipe. The test results are shown in Table 3.

TABLE 3

| | Inventive Nozzle | | | | Comp. Nozzle | |
|---|---|---|---|---|---|---|
| | 1 | 2 | 3 | 4 | 1 | 2 |
| Finish thickness (mm) | 2 | 5 | 8 | 10 | 1 | 12 |
| Melt damage (mm) | 1.1 | 1.1 | 1.2 | 1.1 | 1.0 | 1.2 |
| Spalling test | 0 | 0 | 0 | 0 | 0 | 5 |

From Table 3, it became clear that melt loss to the finish can occur during casting it the thickness of the interior material is less than 2 mm, and that spalling resistance declines markedly if the thickness exceeds 10 mm.

Example 4

Figure 5:
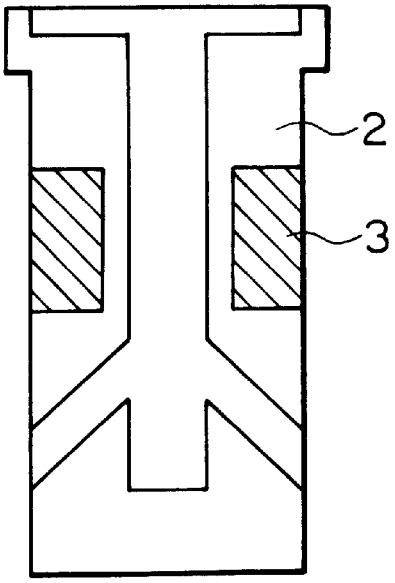
FIG. 5 shows the distribution of materials in a conventional nozzle.

An actual machine test run was conducted to evaluate the efficacy of the nozzle of the present invention. The submerged nozzle shown as Inventive Nozzle 2 in Table 3 above was tested against a conventional comparison nozzle made of a combination of the $Al_2O_3$—C refractory material of Comparative Product 4 from Table 1 and a $ZrO_2$—C refractory material (80 percent by weight of CaO stabilized $ZrO_2$, 20 percent by weight of graphite) with a distribution of materials as shown in FIG. 5.

The test used low carbon aluminum killed steel [composition (wt %): C=0.08; Si=0.03; Mn=0.2; P=0.01; S=0.01; Al=0.05] and was conducted at a casting temperature of 1580° C. After 210 minutes of casting, the thickness of the largest inclusion adhesion layer in the comparative nozzle was 14 mm, whereas in the inventive nozzle it was 2.2 mm, showing a significant reduction in alumina adhesion. Furthermore, there was no cracking or damage to the nozzle interior.

Effects of the Invention

Using the nozzle of the present invention, nozzle blockages due to the adhesion of $Al_2O_3$ inclusions during the casting of aluminum killed steel can be significantly reduced, and no cracking or damage to the nozzle occurs, so aluminum killed steel can be cast continuously for longer periods.

We claim:

1. A nozzle for use in continuous casting of steel, wherein refractory material of at least the interior surface of the nozzle and/or the portions to come into contract with molten steel is composed of amorphous silica and alumina and has a chemical composition of 5 to 40 percent by weight of $SiO_2$, 60 to 95 percent by weight of $Al_2O_3$, and 3 percent by weight or less of unavoidable impurities, said refractory material is composed of raw refractory materials having a grain size of 1000 μm or less and in which the ratio of grains of 0.05 to 1000 μm is at least 80 percent by weight, and the thickness of said refractory material is 2 to 10 mm.

* * * * *